US007195415B1

(12) United States Patent
Vial

(10) Patent No.: US 7,195,415 B1
(45) Date of Patent: Mar. 27, 2007

(54) WRITING INSTRUMENT WITH VARIABLY INCLINABLE TIP

(75) Inventor: Siegbert Vial, Burgwald (DE)

(73) Assignee: Senator GmbH & Co KGaA, Gross Bieberau (DE)

( * ) Notice: Subject to any disclaimer, the term of this patent is extended or adjusted under 35 U.S.C. 154(b) by 0 days.

(21) Appl. No.: 09/889,535

(22) PCT Filed: Jan. 18, 2000

(86) PCT No.: PCT/EP00/00368

§ 371 (c)(1),
(2), (4) Date: Jan. 16, 2002

(87) PCT Pub. No.: WO00/41898

PCT Pub. Date: Jul. 20, 2000

(30) Foreign Application Priority Data

Jan. 18, 1999 (DE) ..... 199 01 629

(51) Int. Cl.
*B43K 7/10* (2006.01)

(52) U.S. Cl. ..... 401/216; 401/109; 401/240; 401/257; 401/116

(58) Field of Classification Search ..... 401/6, 401/216, 109, 101, 116, 117, 148, 235, 240, 401/257, 259, 206, 207, 209, 210, 214
See application file for complete search history.

(56) References Cited

U.S. PATENT DOCUMENTS

| | | | | |
|---|---|---|---|---|
| 1,687,647 | A | 10/1928 | Garvey | 401/206 |
| 2,113,695 | A * | 4/1938 | Krannak | 401/214 |
| 2,592,406 | A | 8/1952 | Faltin | 120/42.4 |
| 2,808,032 | A * | 10/1957 | Ducharme | 401/117 X |
| 3,003,182 | A * | 10/1961 | Rosenthal | 401/207 |
| 3,420,610 | A * | 1/1969 | Malm | 401/101 X |
| 3,554,660 | A | 1/1971 | Woods | 401/214 |
| 4,272,206 | A | 6/1981 | Treen | 401/105 |
| 4,572,691 | A | 2/1986 | Kirchhoff et al. | 401/214 |
| 5,012,663 | A | 5/1991 | Brown | 72/369 |
| 5,172,994 | A | 12/1992 | Brown | 401/209 |
| 5,527,124 | A | 6/1996 | Kolaric | 401/6 |

FOREIGN PATENT DOCUMENTS

| | | |
|---|---|---|
| DE | 801614 | 1/1951 |
| DE | 871258 | 3/1953 |
| DE | 902352 | 1/1954 |
| FR | 1032122 | 6/1953 |
| FR | 1253384 | 12/1959 |
| FR | 1394150 | 2/1964 |
| FR | 2151240 | 4/1973 |
| WO | 97/22482 | 6/1997 |
| WO | 98/13216 | 4/1998 |

OTHER PUBLICATIONS

Copy of Chinese Office Action and Search Report.

* cited by examiner

*Primary Examiner*—Khoa D. Huynh
(74) *Attorney, Agent, or Firm*—Duane Morris LLP

(57) ABSTRACT

A writing instrument is ergonomically adjusted to the position of a user's hands. The writing device has a substantially tubular shaft along a main axis, a terminal part at the rear end of the shaft and a substantially conical tip at the front end of the shaft. Using the terminal part, the tip can be pivoted (inclined) in a controlled manner in relation to the shaft in a plane containing the main axis. Alternatively, an angle of inclination of a cone axis of the tip can be adjusted in relation to the main axis.

2 Claims, 5 Drawing Sheets

50
50b
50d
100
20
21
23
30
40
101
α
$0 \leq \alpha \leq \alpha_{max}$ 50
40
28
47
9
10
100
41
42
L
34
30
44
43
x 10
16
11
9
12
13
14

12
13
15

10
29
12
15
13
11
12

16
17
9a
9b
9
13
β
15

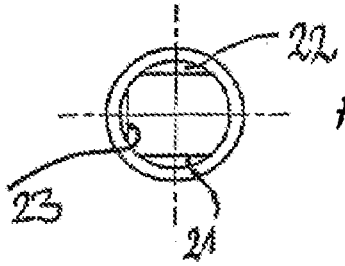
Fig. 4C
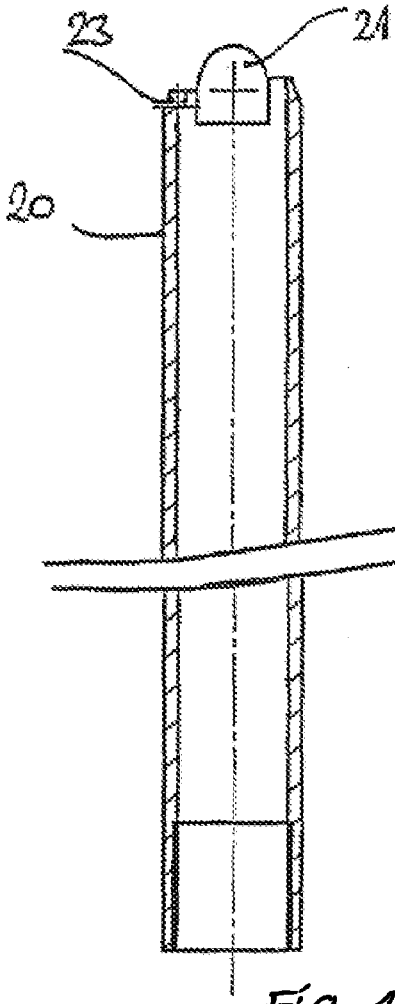
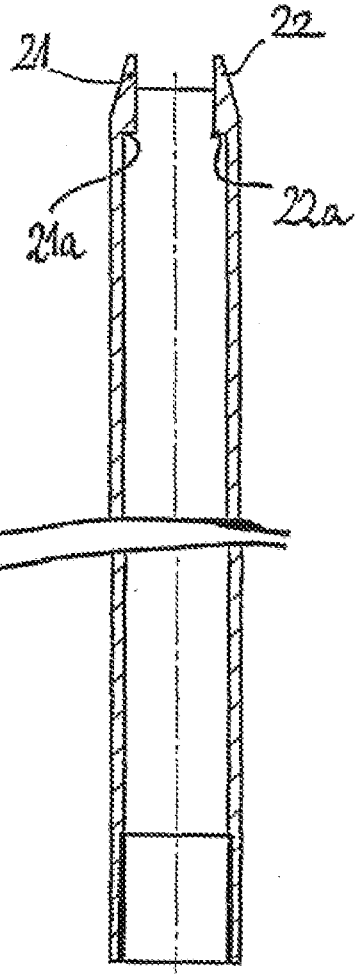
Fig. 4B
Fig. 4D
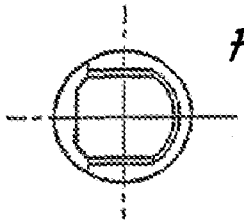
Fig. 4A

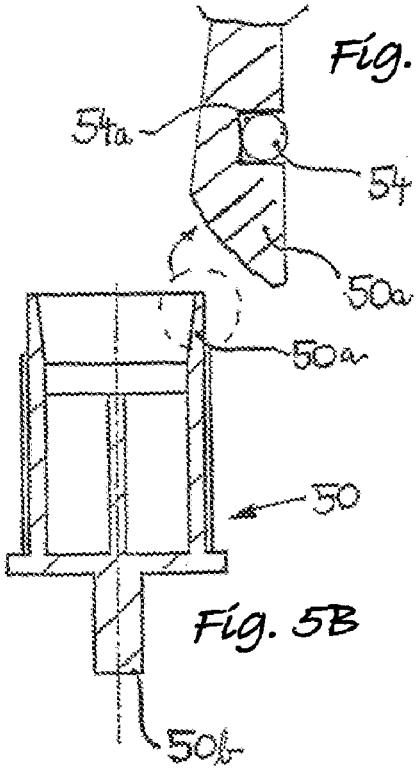
Fig. 5E
Fig. 5B
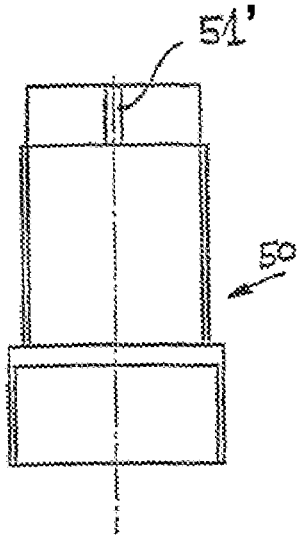
Fig. 5C
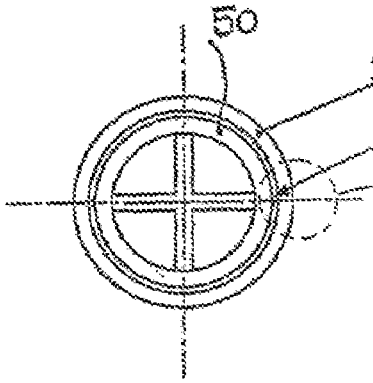
Fig. 5A
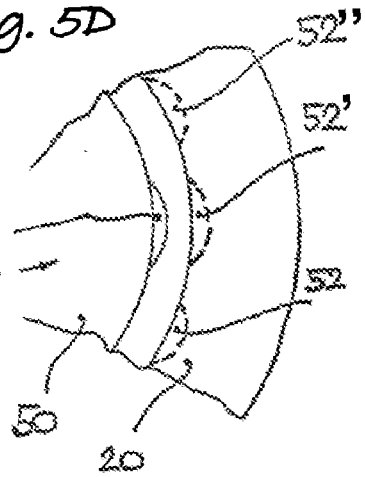
Fig. 5D

WRITING INSTRUMENT WITH VARIABLY INCLINABLE TIP

BACKGROUND OF THE INVENTION

1. Field of the Invention

The invention relates to writing instruments which are ergonomically adapted to a user's hand posture. The term "writing instruments" is understood to comprise all writing instruments which are adapted to be handled and transported, i.e. which are used by a user as a ball-point pen, roller ball, felt pen or fountain pen. Writing instruments with ink devices or refill cartridges are also comprised.

2. Prior Art

Many decades ago, efforts were made to provide the tip shape of a writing instrument at the front end of a shaft with a shape tapered towards the front end and to simultaneously incline the tip in relation to the axis of the writing shaft, compare the old documents FR 1,032,122 A (Segal/Flicker), FR 2,151,240 A (Droubay) or the old German document DE 871 258 C (Riepe-Werk).

Only in recent years, the concept has been taken up again to improve the idea of an inclined writing tip with regard to industrial engineering, said obviously outdated idea having disappeared from the catalogue of ideas of the manufacturers of writing instruments, see for example documents WO 98/13216 A1 (Senator/Vial) or WO 97/22482 A1 (Gilette). Whereas the last mentioned WO-document relates to a tip design as described in the first mentioned FR-document, namely designing the front end as a double curvature of a tip device tapered towards the front to obtain an orientation directed away from the writing surface on one hand, and on the other hand, very close to said tip device, an orientation directed towards said writing surface again, the last but one WO-document by Vial proposed to provide a writing tip inclined in one direction only, an elongated design of a front end being selected as an inclined or "asymmetrical" cone at the front shaft end. Such a design permits to improve the control by the user who has a better view of the writing end of the writing instrument due to the slim elongated tip.

The modernization in the field of technical engineering according to the preceding paragraph concerned a stationary tip inclination. Already many years ago, an adjustable tip arrangement according to DE 801,614 (dating 1951, Ganter) was proposed in which a ball or disk joint relative to a schematically indicated tip was provided, said tip having been mounted at a shaft with a nut (designated d there) after adjusting said ball-disc joint. Still earlier, in 1928, a writing instrument was proposed in U.S. Pat. No. 1,687,647 (Garvey), said writing instrument permitting a very closely limited tip inclination, oriented at an axially arranged "rigid tip holder 10" as described therein and releasing the flow of a writing medium upon being slightly bent. Upon bending, the user adjusts the rate of flow of the writing medium to generate thick and thin lines by correspondingly pressing on the tip (compare page 2, lines 38 to 52 of said document). Finally in 1971, it was proposed to provide a tube arrangement with a disc joint at the front end and with a tip, said tip being adapted pivotable relative to an axis of said tube, compare U.S. Pat. No. 3,554,660 (Wood). According to this document, a disc-shaped joint (designated 9,10 in FIG. 2 of said document) is axially offset and laterally offset with respect to a pivoting plane (3—3 therein).

3. SUMMARY OF THE INVENTION

Based on the above-mentioned prior art, it is an object of the invention to provide writing instruments having a tip device tapered towards the front end with an ergonomic design and to adapt the posture of different users' hands better to said writing instrument, said posture as well as the handwriting of the users mostly substantially differing from one another, particularly to improve the operation of adjustment of the inclination at the writing instrument.

Said object is realized according to the invention by providing the substantially conical tip device adapted to be adjusted in its inclination relative to an axis of a substantially sleeve shaped writing shaft and by an adjusting means actuated by the user himself, said tip device maintaining its changed position after said adjustment or being directly adjustable again by said adjusting means. Thus, it is up to the user to control or adjust an inclination of the tip of said elongated tip device at the front shaft end such that it is suitable and agreeable to him.

Therefore according to the invention, a writing instrument comprises a sleeve-shaped shaft, having a main axis, a terminal control part at a rear end portion of said shaft, and a substantially conical tip device at a front end portion of said shaft, wherein said tip device is tiltable to an inclination angle, wherein said tip device is controlled in an angular position there, and pivotably inclinable in a plane comprising said main axis and relative to said sleeve-shaped shaft, wherein the inclination angle is variable in relation to said main axis of the shaft and the terminal control part controls the angular position of the tip device. A leaf spring is provided at a backwards facing portion of said tip device, said leaf spring extending into an inside of said sleeve shaped shaft and contacting an inner surface of a wall of said sleeve shaped shaft for effecting a resetting force on said tip device, upon a controlled increase of said inclination angle of said tip device, said force increasing when said control part increases the angular position of the tip device. Said adjustability comprises a single adjustment and a change, an adjusted and changed position of a cone axis of a substantially conical tip device being changed relative to an axis of a writing shaft. A variation range between 0° and 20°, particularly around 10° to 15° was found to be sufficient for most hand postures of the different users.

Thus, a writing instrument according to the invention is operable in a straight position, in which the two axes (a tip axis and a writing shaft axis) are substantially congruent, and also in an inclined (tilted or pivoted) position, in which the tip with its axis is changed relative to the shaft axis.

A returning force, moving said tip from its changed inclined position back to a straight position, may be obtained by providing an elastic portion of a refilling device or cartridge arranged in said shaft axis or a spring means applying a force component on said tip device, such that a torque around a bearing of said tip device at the shaft is generated, said torque urging said tip device back into its basic position.

The adjusting movement which extends in a plane comprising the main axis of said writing shaft and the cone axis of said tip device may be controlled with the help of a backwards facing portion of said shaft. The inclination angle of the tip device can be changed from the terminal control part providing a longitudinal movement of one of an ink device and a refilling device received in said sleeve shaped shaft, said movement being effected in a longitudinal direction along said shaft.

A control from the rear is effected by a terminal part provided at a shaft end, said terminal part being rotatable. A rotation changes an axial position of said refilling device (axially extending cartridge) over which a longitudinal movement and a force are applied on said tip device located at the front shaft end. A movement of said cartridge towards the front, even by a relatively small rate, changes the inclination of said tapered head, a shoulder of said cartridge device being coupled to the rear portion of said head, particularly directly contacting or permanently contacting said portion in the form of a contour control.

Alternatively, a control is not only provided by employing said terminal part, but also by a control ring arranged close to said pivotable head, said control ring being arranged around said shaft and accessible to the user for effecting said control.

In both alternatives, a change of the tip inclination is effected from the terminal part. Said change starts out from the rear part of the writing instrument predetermining said change of said tip device (of a substantially cone-shaped front end of a shaft) either directly or indirectly. Said tip inclination is changed "starting out from said terminal part", depending on the concrete embodiment to which said abstract principle is applied, a writing instrument having a push button, a writing instrument having a closed end and a non-retractable refilling or cartridge means, or a writing instrument changing the position of its refilling device by operations other than axial operations. When an adjusting means is provided close to said terminal part, said adjusting means changes the inclination of the tip directly over said refilling or cartridge means, or at least predetermines said inclination (the pivot angle), when the then predetermined tip inclination is adjusted by retracting the front portion of said cartridge device upon using said writing instrument. When said adjusting means is located closer to the front, e.g. close to said tip device, said terminal part is displaced further to the front in relation to said tip device by changing the length of said shaft (in case of a two-piece shaft) or of the entire writing instrument, so that the refilling device located in said shaft is also displaced further towards the front end. Thus, said tip inclination is changed starting out from said terminal part, or it is at least predetermined from said terminal part. An adjustment is made indirectly with the help of the remaining sleeve portion of said shaft between an adjusting means displaced towards the front end and said terminal part.

Said adjusting means may have a sleeve-shaped structure and may be connected with at least one thread portion to the front or to the rear shaft part—in case of a divided shaft—, the distance of said connection being variable.

The preceding ideas may be combined optionally, e.g. an adjusting sleeve close to a pivotable tip device and a writing instrument with a closed rear terminal part; the same with a push button provided at the terminal part, for operating a refilling device and releasing said refilling device (writing position/retracted position); an adjusting means located at the terminal part comprising a separate push button for moving said refilling device in a writing position or in a retracted position; the same with a writing utensil comprising a closed terminal part.

Advantageously, an axial pre-tensioning is used, said pre-tensioning being applied on said refilling device over a spring means, mostly a cylinder spring. On one side, said spring means is supported at said writing instrument, on the other side it contacts said refilling device. When said axial spring is located in the front portion of said refilling device, it contacts said pivotable tip device and urges said refilling device backwards against a closed shaft end or against a push button for axially moving said refilling device against said spring force. Thus, a coupling of said refilling device and said tip device may be neutralized by spacing a shoulder of said refilling device from said contacting position at the backwards facing end portion of said tip device. When said spring means is located at the rear end portion of said shaft, it urges said refilling device towards the front, the term "urging" being equivalent to an axial pre-tensioning. The last mentioned embodiment of use may also be applied with a writing instrument with refilling cartridge, said instrument having a closed shaft end or a terminal push button part.

Said spring means may have a double function, namely pre-tensioning said refilling device with respect to a push button means, and a follow-up function of said refilling device when changing the inclination of said tip device upon influencing said writing instrument over an adjusting mechanism and said adjusting mechanism effecting said change of said tip inclination "(directly or indirectly) starting out from said terminal part".

A coupling portion of said refilling device with the rear portion of said tip device is laterally offset in relation to a bearing portion, at which said tip device is supported to be pivotable.

For improving a guiding in a pivoting plane, said tip device may be guided on two sides extending in parallel with respect to said plane, said guiding being effected from said shaft by protrusions extending towards the front. Preferably, said tip device is flattened to provide a larger contact surface at said protrusions.

A leaf spring additionally provided at a rearwards facing end of said tip device, which spring may be located on the opposite side of the described bearing, provides an increased dynamic effect upon pivoting said tip device to be more inclined, said dynamic effect resulting from a contact of said leaf spring with the inner surface of the shaft wall. Thereby, a returning torque is achieved even when no refilling device with elastic portion is provided, so that a writing instrument not having a refilling device also has a tip with a substantially straight orientation, in which writing instrument a refilling device may simply be inserted from the rear, said refilling device being controllable itself in its longitudinal movement by said terminal part and releasing an inclination movement of said tip over the described contour control.

When an integral arrangement comprising a tip tapered towards its front end (substantially conical tip device) and a sleeve shaped shaft is used, said bearing may be provided by an elastically flexible transition, whereas in the remaining portion, said tip is uncovered from said shaft and variable with respect to its inclination; in this case, said elastic transition constitutes said bearing position permitting said inclination movement; e.g. a thin hinge or plastics hinge joint.

A control is not only possible (starting out) from said shaft, it may also be effected directly over a control ring, particularly close to a pivotable head, said control ring being arranged around said shaft and accessible to the user for effecting said control.

When a control is possible both from said shaft and also directly at said pivotable head, an adjusting means located further in the course of said gripping shaft may be used, when a corresponding coupling possibility to said tip exists. When said adjusting means is located at said tip, it may directly act upon said pivotable tip. When said adjusting means is located at the terminal part of said shaft, it may act upon said tip over a refilling device. Therefore, by using a corresponding, e.g. inside sleeve element, it is also possible to use a movement component of the middle of said writing instrument or of each other position between the front and the rear end for providing an adjusting means which adjusts said tip device.

An adjusting means is provided at an axial distance from the front end of said shaft.

Both, an adjustment against a spring force, and also a direct adjustment, by simply displacing or rotating an adjusting means located at said shaft, are possible.

When spring forces are used, a coordination of at least two different spring forces is recommended, also taking into account a writing pressure usually resulting from writing and acting on said refilling device. A first torque existing in a direction of inclination may at least be compensated by an increased returning torque, an inclination angle adjusted to be stationary by a mechanically adjustable coupling, particularly a contact, being maintained, when forces caused by writing act upon said tip device.

A spring means at the rear end may compensate a writing force applied over a refilling device, said force usually being between 100 g and 150 g, such that said refilling device is not offset in an axial direction; simultaneously said spring force allows said refilling device to be advanced upon pivoting said tip device, so that the writing end continues to protrude out of said tip device. When a dynamic component is additionally applied for returning said protruding tip, either by a flexible portion of a part of said refilling device or by an additional spring means in the sense of a leaf spring, or by both said means, the entire dynamic component for a return in the sense of a returning torque has to be oriented such that the total returning force is higher than a force in an axial forward direction of a spring supported at the rear, said force in turn having to correspond to a force normally resulting from a writing pressure. Thus, all three states of a writing instrument may optimally be combined, a writing positioned a writing process as well as a returning of the inclination angle, as well as a guarantee that upon an increasing inclination, said tip continues to protrude out of said tip device in the same manner.

When using a spring arranged at the front end, which spring urges said refilling device back and is adapted to space said tip device from a control shoulder portion of said refilling device by applying an elastic tension force, a dimensioning basis may also be given here. Said elastic pre-tensioning between the two components described resulting in that said tip device is urged in a more inclined position, a returning spring at an edge of said tip device has to take care that said torque is at least compensated and that an additional torque is applied, permitting a return of said tip device, when a smaller inclination is desired by operating said adjusting means at said shaft.

A non-interaction of a change of said refilling device and an adjustment and maintenance of a certain inclination of said tip device is particularly preferred. Thus, a user may adjust his preferred inclination angle which he does not loose even when providing said writing instrument with another or a new refilling device. For such an embodiment, a combination of an adjusting means at a terminal shaft part in connection with a divided housing shaft is advantageous. A control at said terminal part is independent of a shaft being divided by unscrewing for changing said refilling device. Both functions of said writing instrument are accomplished simultaneously and are independent of each other.

BRIEF DESCRIPTION OF THE DRAWINGS

The claimed invention is described and supplemented by embodiments and examples, certain of which are specifically shown in the drawings, wherein:

FIGS. 4A to 4D (collectively "FIG. 4") comprise four illustrations, showing the design of a sleeve shaped shaft 20 in a sectional view in two sections offset by 90° as well as in two axial views.

FIGS. 5*a* to 5*e* (collectively "FIG. 5") illustrate a number of embodiments for mounting a terminal part 50 at a rear shaft end 20.

DETAILED DESCRIPTION

Figures 1A, 1B, 1C:
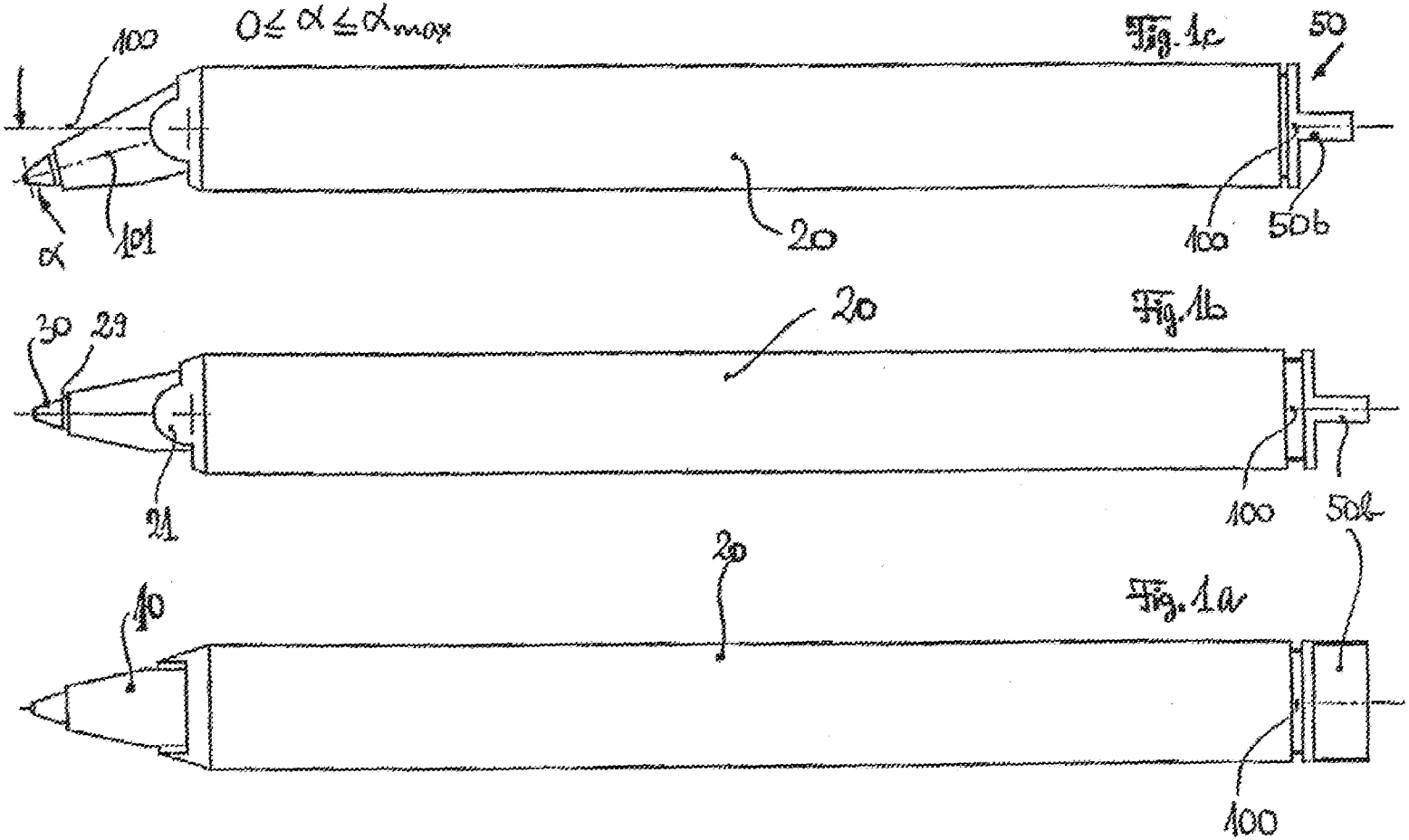
FIGS. 1*a* through 1*c*, which for convenience are sometimes collectively referenced herein as "FIG. 1," comprise three illustrations showing an embodiment of a writing instrument having a pivotable tip device, which in this embodiment is designed as a cone 10.

FIG. 1*a* shows writing instrument illustrated in a top plan view, which writing instrument in a side view according to FIG. 1*b* has a straight orientation, and in a side view according to FIG. 1*c* has an inclined tip device 10, said inclination being at an angle $\alpha$ relative to a shaft 20, in this embodiment shown at substantially 15°. Two marked axes 100 and 101 serve for orientation, said first mentioned axis being a main axis of said shaft 20, also constituting an axis of said writing instrument, said last mentioned axis being an axis of said tip device 10, which in the inclined illustration, in which said two axes include an angle of 15°, has changed its inclination in a paper plane. Said inclination is variable between 0° and $\alpha_{max}$.

At the front end of said conical tip device 10, which has an opening 10*a* at said front end, a writing tip 30 protrudes, said writing tip changing its inclination simultaneously with the inclination of said cone 10. The cone 10 is conically shaped.

As far as the functionality of the writing instrument is concerned, reference is made to FIG. 5 with regard to the terminal part 50 of FIG. 1. As far as a more exact design of said sleeve shaped shaft 20 also with its front guiding protrusions 21, 22 is concerned, reference is made to FIG. 4. FIG. 3 show a more detailed illustration of said tip device 10. The operation or the pivoting possibilities, particularly the application of returning forces on said conical tip result from FIG. 2.

Figures 2A, 2B:
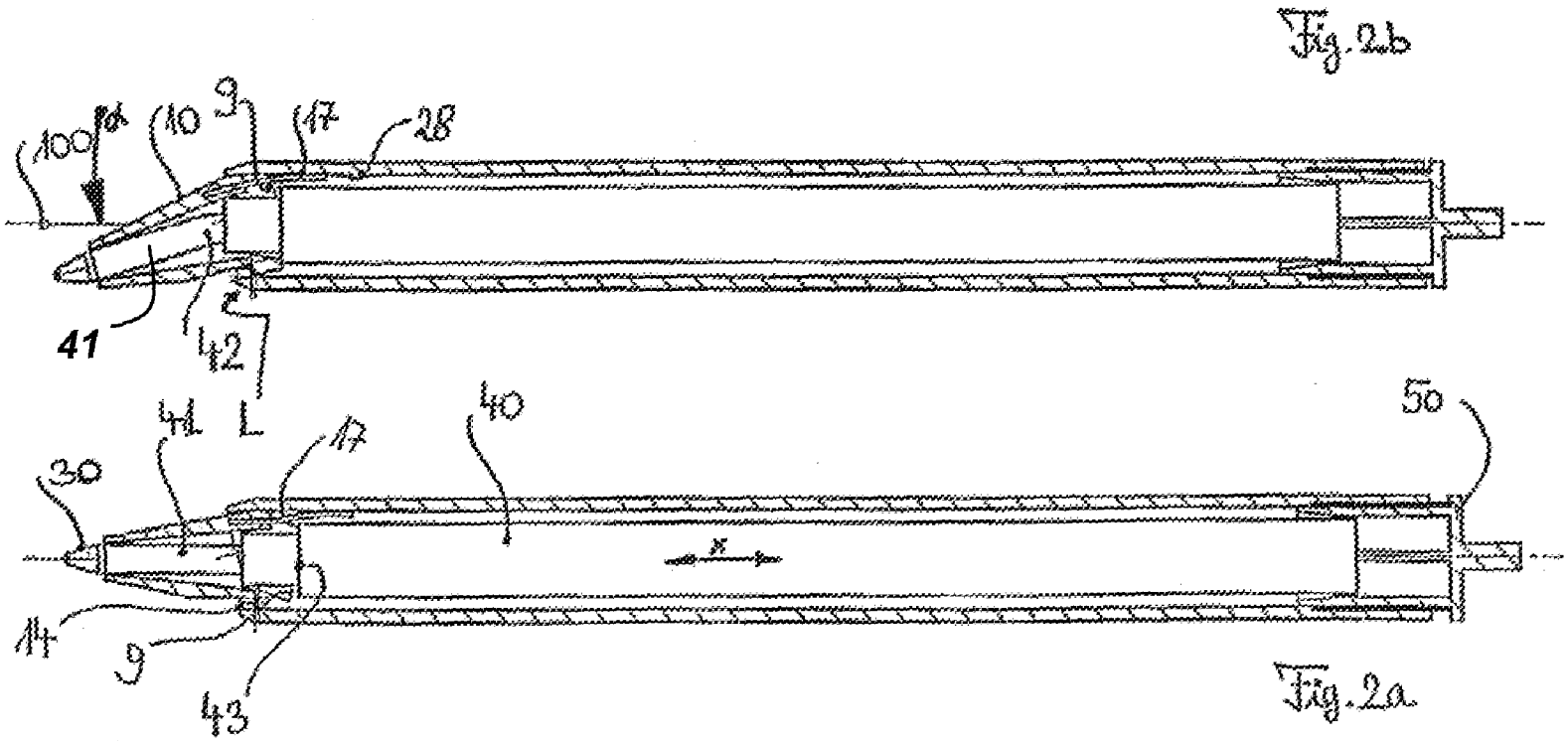
FIGS. 2*a* and 2*b* (collectively "FIG. 2") show in two sectional illustrations the embodiment of FIG. 1, with a conical tip device being in a straight position and an conical tip device being inclined by engagement of a refilling device 40 at a rear control portion 9 of said conical tip, said tip being pivotable at a hinge.
Figures 3A, 3B, 3C, 3D:
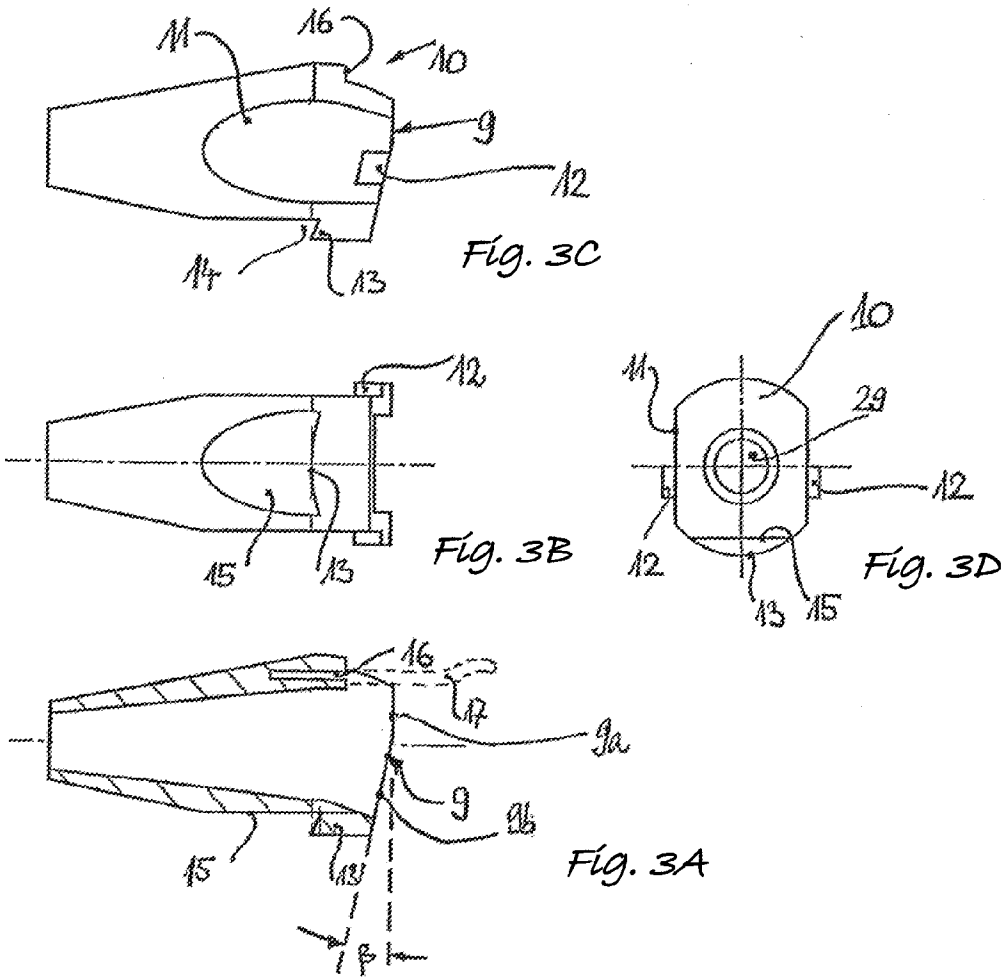
FIGS. 3*a* to 3*d* (collectively "FIG. 3") comprise four illustrations, showing the design of a conical tip device 10 comprising the control portion at the backward facing portion as well as further elements for improving the functionality of the variable inclination of said tip device 10.

FIG. 2 illustrate the writing instrument of FIG. 1 in a sectional view, however, in this embodiment a refilling device 40 being provided in said shaft 20, said refilling device being supported at the backwards facing end at said terminal part 50, and comprising a writing tip 30 at the front end, a channel portion 41, which has a considerably smaller diameter, leading into a step or shoulder portion 43, having a diameter corresponding to a so-called "high capacity" or "large volume" ink device or cartridge for storing a writing liquid. The embodiment illustrated thus shows a roller ball or a ball point pen, however, it may have the same design for corresponding other shapes of refilling devices, such as felt tip pens or pens.

Supposed that said ink device 40 moves in a longitudinal direction x, in parallel to said main axis 100, and over a small distance in a forward and a backward direction, said front step or shoulder 43, as an annular surface at a contact position with the rear end of said conical tip 10 transfers a pivoting movement on said tip, when said tip is arranged to be inclinable, tiltable or pivotable at a bearing L offset with respect to said axis 100. Said bearing comprises two opposite protrusions 23, 23, one being located at the front end of said shaft and at the inside thereof, the other being arranged at an outer and backwards facing end of said conical tip, so that said two protrusions form a bearing L for a conical tip device 10 being inserted from the rear, around which bearing said tip device 10 is pivotable.

Said pivoting movement is initiated by the described longitudinal adjustment of said ink device 40. Said shoulder 43 is in contact with a contour control portion 9 comprising two webs at the backward facing end of said tip device, which webs may have a semicircular or a straight shape. In a direction perpendicular to said main axis 100, said webs have a spherical shape or comprise two web pieces, each of which having a straight extension, but at an angle differing from 180°. Said inclined extension 9*a*, 9*b* corresponds to a substantially desired maximum inclination of said cone 10, so that an angle β illustrated on FIG. 3 substantially corresponds to said angle αmax of FIG. 1.

Upon inclining said tip, an elastic portion 42 of the channel portion 41 of said refilling device bends out under application of a returning force, so that, upon a returning movement of said refilling device, said tip reduces its inclination achieved before. Additionally, a leaf spring 17 may be inserted into a recess 16 in said tip device, said leaf spring starting to apply returning forces relative to the inside wall surface 28 of said shaft 20 upon an increasing inclination.

Two laterally protruding limiting means 12 are provided, said means being offset by ±90° in relation to said bearing L comprising protrusion 23 and providing a limiting position of said tip device 10 at further limiting means 21*a*, 22*a*, located correspondingly inside said shaft and at a forward facing end thereof, said limiting means 21*a*, 22*a* being visible on FIG. 4. When said conical tip device 10 reaches its maximum inclination, said two noses contact said protrusions 21*a*, 22*a* and limit a further pivoting movement; at said state of inclination, the shoulder 43 of said refilling device 40 is also in a plane-parallel contact with said portion 9*b* of said inclined contour control 9.

For improving the function of said bearing L making up the joint between sleeve shaft and conical tip device, said conical tip device 10 is provided with a flattened portion 15 in the area of said bearing portion, said flattened portion having a heraldic- or blazon-shaped design and an edge oriented towards the rear and having a substantially straight extension, from which edge said protrusion 13 at said conical tip 10 originates. A step 14 connects protrusion 13 and flattening 15 (a flattened portion).

A lateral control of said cone 10 is improved, when two protruding guiding plates are arranged in an axial direction 100 at two sides offset by 180°, each offset in parallel with respect to a plane in which the inclination movement is effected. They act together with corresponding flattened portions 11 at said tip device 10 for obtaining a bilateral guiding on the left and on the right of said bearing L, comprising protrusion 23. Said plates protrude in a semi-oval shape from said shaft 20 and are visible on FIG. 4 as plate pieces 2122. The corresponding flattened portions 11 at said tip device 10 are illustrated in FIG. 3.

A number of embodiments for realizing a terminal part 50 are accessible to the expert in FIG. 5 (FIGS. 5A to 5D). An embodiment of realizing a longitudinal movement x of a refilling device 40 is to provide said terminal part 50 as a stopper or plug which is guided in a thread by one or two opposite spherical protrusions 51, so that a rotary movement of said plug or stopper 50 effects its longitudinal movement. Said longitudinal movement is transferred to said refilling device 40, which for its part changes the inclination of the tip over said contour control 9 and maintains said inclination in said changed position, thus controls it.

Alternative embodiments may be realized by providing said plug or stopper 50 with an annular recess 54*a* in a cylindrical portion 50*a*, in which recess an O-ring 54 is located, which O-ring slightly protrudes in a radial direction and engages in said thread.

A further—not illustrated—alternative is to provide said terminal part 50, which is only adapted to be rotatable at said rear shaft end, with a surface inclined towards the front, said surface being adapted to transfer longitudinal forces to said refilling device 40, upon being rotated and contacting said refilling device 40.

When said shaft has an integral design, said tip device, for assembling purposes, may be inserted into said shaft 20 from the back side thereof. When said shaft is divided in two parts—said embodiment being described further below, the dividing position offers itself as an inserting position, when said two shaft parts are detached from each other and separated.

A terminal part according to FIG. 5C is provided with protrusions 51', which have a line-shape. They may also be locked in corresponding lock-in positions 52, 52', 52" at the inside of said shaft for fixing predetermined positions upon a rotary movement, said positions corresponding to defined angle positions of said tip device. When said protrusions are designed to have a substantially punctual shape, they are suited as a thread engagement as shown in FIG. 5A. Both elements may also be combined, said combined application being symbolically represented in the illustration of FIG. 5D, according to which said protrusions 51 in said thread and said lock-in positions (with line protrusion 51') without said thread, are also realizable.

A stripe-shaped web 50*b* protrudes in an outward direction, at which web the rotary movement for said terminal part 50 is effected.

The force of a spring 17 according to FIG. 3 has to be adjusted such that the returning force is sufficient, if necessary in combination with a compressive stress of an elastic portion 42 of a channel section at the front end of said refilling device. A contact position of said leaf spring 17 should be offset to the rear, in relation to a bearing position L, for allowing a torque to be applied with a lever arm on a tip device 10, even when said tip device 10 is bent out or inclined.

What is claimed is:

1. A writing instrument comprising:

a sleeve-shaped shaft (20), having a main axis (100), a terminal control part (50, 35, 20*b*) at a rear end portion of said shaft, and a substantially conical tip device (10) at a front end portion of said shaft (20), wherein said tip device (10) is tiltable to an inclination angle, wherein said tip device (10) is controlled in an angular position there, and pivotably inclinable in a plane comprising said main axis (100) and relative to said sleeve-shaped shaft (20), wherein the inclination angle is variable in relation to said main axis (100) of the shaft and the terminal control part controls the angular position of the tip device;

wherein a leaf shaped spring (17) is provided at a backwards facing end portion of said tip device (10), said leaf spring extending into an inside of said sleeve shaped shaft and contacting an inner surface of a wall of said sleeve shaped shaft for effecting a resetting force on said tip device, upon a controlled increase of said inclination angle of said tip device, said force increasing when said control part increases the angular position of the tip device.

2. The writing instrument according to claim 1, wherein said inclination angle of the tip device is changed from the terminal control part providing a longitudinal movement of one of an ink device and a refilling device (40) received in said sleeve shaped shaft, said movement being effected in a longitudinal direction along said shaft (20).

* * * * *